US006483393B1

(12) United States Patent
How

(10) Patent No.: US 6,483,393 B1
(45) Date of Patent: Nov. 19, 2002

(54) METHOD AND APPARATUS OF OBTAINING PHASE SHIFT USING NONRECIPROCAL RESONATOR

(76) Inventor: Hoton How, 262 Clifton St., Belmont, MA (US) 02478

( * ) Notice: Subject to any disclaimer, the term of this patent is extended or adjusted under 35 U.S.C. 154(b) by 0 days.

(21) Appl. No.: 09/934,938

(22) Filed: Aug. 23, 2001

(51) Int. Cl.[7] ..... H01P 1/19; H01P 1/32; H01P 7/00

(52) U.S. Cl. ..... 333/24.1; 333/219.2

(58) Field of Search ..... 333/1.1, 219.1, 333/219.2, 24.1, 139, 166; 372/94; 505/210; 332/103

(56) References Cited

U.S. PATENT DOCUMENTS 4,271,397 A * 6/1981 Stiles et al. ..... 372/94
4,904,965 A * 2/1990 Blight et al. ..... 333/1.1
4,920,323 A * 4/1990 Schloemann et al. ..... 333/1.1

* cited by examiner

*Primary Examiner*—Patrick Wamsley

(57) ABSTRACT

Disclosed is a method and two devices for obtaining phase shifts by using a non-reciprocal resonator supporting single-mode operation. As such, wave propagation in the resonator is unambiguous in phase, allowing the phase to be coupled in or out at different positions. This results in novel phase shifter devices of two kinds: One kind of the devices suggests to change the coupling positions by using switches, and the other kind suggests to use a movable port to be driven by a step motor, for example. In this invention the phase-shift function performed by a non-reciprocal resonator invokes no use of a transmission line, none for the adjustment in its electronic properties, including permittivity and permeability. The operation of the disclosed phase shifter devices is uniform, being independent of the phase-shift angles, exhibiting low insertion loss and low return loss. Depending on the purpose of applications, versatile phase shifter devices can thus be fabricated, showing the following advantages, economy, reduced size, fast response, high isolation, minimum internal reflection, and compatibility with the current semiconductor fabrication techniques. This invention favors the fabrication of large phased array systems, where available space, cost, and power dissipation can be of primary concerns.

17 Claims, 4 Drawing Sheets

METHOD AND APPARATUS OF OBTAINING PHASE SHIFT USING NONRECIPROCAL RESONATOR

CROSS-REFERENCE TO RELATED APPLICATIONS

Not Applicable

BACKGROUND—FIELD OF INVENTION

This invention is directed to a method and two devices for obtaining phase shift. Phase shift can be readily obtained via coupling in or out a non-reciprocal resonator at selective positions. As a result, phase shifters can be thereof fabricated with reduced size and economy, so as to be favorably applied in a large phased array system performing the functions of beam steering, forming, and nulling, etc..

BACKGROUND—DESCRIPTION OF PRIOR ART

Microwave and millimeter-wave (MMW) devices and systems are becoming increasingly important today for both defense and commercial applications. For example, in the collision avoidance industries, low-profile antennas are needed providing electronically steerable radiations to detect and identify obstacles and protrusions in front of a moving vehicle. Upon navigation the receiver antennas need to follow and trace the motion of GPS (Global Positioning Systems) satellites so as to continuously monitor and update their positions. Also, there is a need to create radiation nulls along certain spatial directions for an antenna transmitter/receiver to warrant secure and covert communications. Other applications can be found in target searching/tracking radars, satellite communication systems, and TV program broadcasting antennas installed with a civilian jet carrier.

In a phased array system it is possible to include frequency-agile materials (varactors, ferroelectrics, and ferrites) to tune and adjust the phase and amplitude of each individual element so as to compose and tailor the overall radiation into a desirable pattern. However, beam forming in this manner is costly; depending on the speed, frequency, and angle of steering, each phase-shifting element can cost as much as $ 1,000, and in a system containing 10,000 elements, the cost of the antenna array system can be formidable. Power dissipation is another consideration, since amplifiers are used following each of the phase shifting processes to compensate signal propagation loss, or insertion loss. To avoid overheating, water cooling is, therefore, often applied in a large phased array system.

A radiation beam can also be steered via mechanical means, as commonly observed for a traffic radar installed at the airports. However, steering in this manner is slow, suffering from potential mechanical breakdowns. To incorporate free rotation, the antenna take up considerable space and the shape of the antenna is not conformal. As such, it is unlikely to apply a mechanically rotating radar in a body moving at high speed.

Collision avoidance radars are popular these days installed with automotive ground vehicles and with airline jets. However, the current collision avoidance radars perform only the basic functions for target detection; these radars are not able to recognize a target, and hence they do not have the intelligence to handle targets of different kinds. In order to give the radar such intelligence, a steering radar is needed, performing image reconstruction based upon information collected from a steering beam. This requires an array of radiators whose phases can be controlled with accuracy in an economic manner.

Conventionally, a phase shifter is obtained by incorporating a transmission line whose electric length, or electric permittivity and/or magnetic permeability, can be varied by applying a voltage, a current, or a bias magnetic field. However, to obtain a large angle in phase shift a long line is needed, which translates into high cost and large volume. Also, insertion loss can be a serious problem if the phase shifter demands a long transmission line to operate. Otherwise, significant return loss will result, if the electric property of the transmission line has been changed aggressively, due to the resultant change in line impedance. Even worse, in applications for a large phased array a large number of phase, shifters is required, and there are problems such as how to integrate the phase shifters with the array system providing compatibility and uniformity with economy and size fit.

Accordingly, it is an objective of the invention to address one or more of the foregoing disadvantages or drawbacks of the prior art, and to provide such improved method and apparatus to obtain phase shift, permitting fast response with economy and reduced size, providing compatibility and uniformity when integrated with a large phased array system without requiring the use of amplifiers for signal propagation-loss compensation.

Other objects will be apparent to one of ordinary skill, in light of the following disclosure, including the claims.

SUMMARY

In one aspect, the invention discloses a method and two devices for achieving phase shift via the use of a non-reciprocal resonator which maintains a fixed phase relationship for wave propagation along its periphery. Thus, by selectively coupling in or out the resonator at various positions the desired amount of phase shift can be obtained, resulting in phase shifters with compact size and economy.

In another aspect, the invention discloses a method and two devices for achieving phase shift via the use of a non-reciprocal resonator whose performance can be accomplished via the use of switches of many kinds, including optical switches, electronic switches, mechanical switches, or electromechanical switches, providing versatility in a broad range of applications.

In another aspect, the invention discloses a method and two devices for achieving phase shift via the use of a non-reciprocal resonator without requiring the use of a transmission line. As a consequence, the amount of phase shift obtained is independent of the size of the resonator, resulting in uniformity in device operation, as required by a large phased array system containing a large number of phase shifters.

In another aspect, the invention discloses a method and two devices for achieving phase shift via the use of a non-reciprocal resonator without requiring the use of a transmission line. As a consequence, the resultant insertion loss is low, thereby eliminating the need for an amplifier. In other words, heat dissipation is not a problem, and there is no need to incorporate water cooling in a large phased array system containing a large number of phase shifters.

In another aspect, the invention discloses a method and two devices for achieving phase shift via the use of a non-reciprocal resonator whose size can be possibly miniaturized to be compatible with the fabrication of a large phased array system.

In another aspect, the invention discloses a method and two devices for achieving phase shift via the use of a non-reciprocal resonator whose operation frequency can be electronically tuned so as to be used in broadband applications.

BRIEF DESCRIPTION OF THE DRAWINGS

For a more complete understanding of the nature and objectives of the present invention, reference is to be made to the following detailed description and accompanying drawings, which, though not to scale, illustrate the principles of the invention, and in which.

DETAILED DESCRIPTION

REFERENCE NUMERALS IN DRAWINGS

Figure 1:
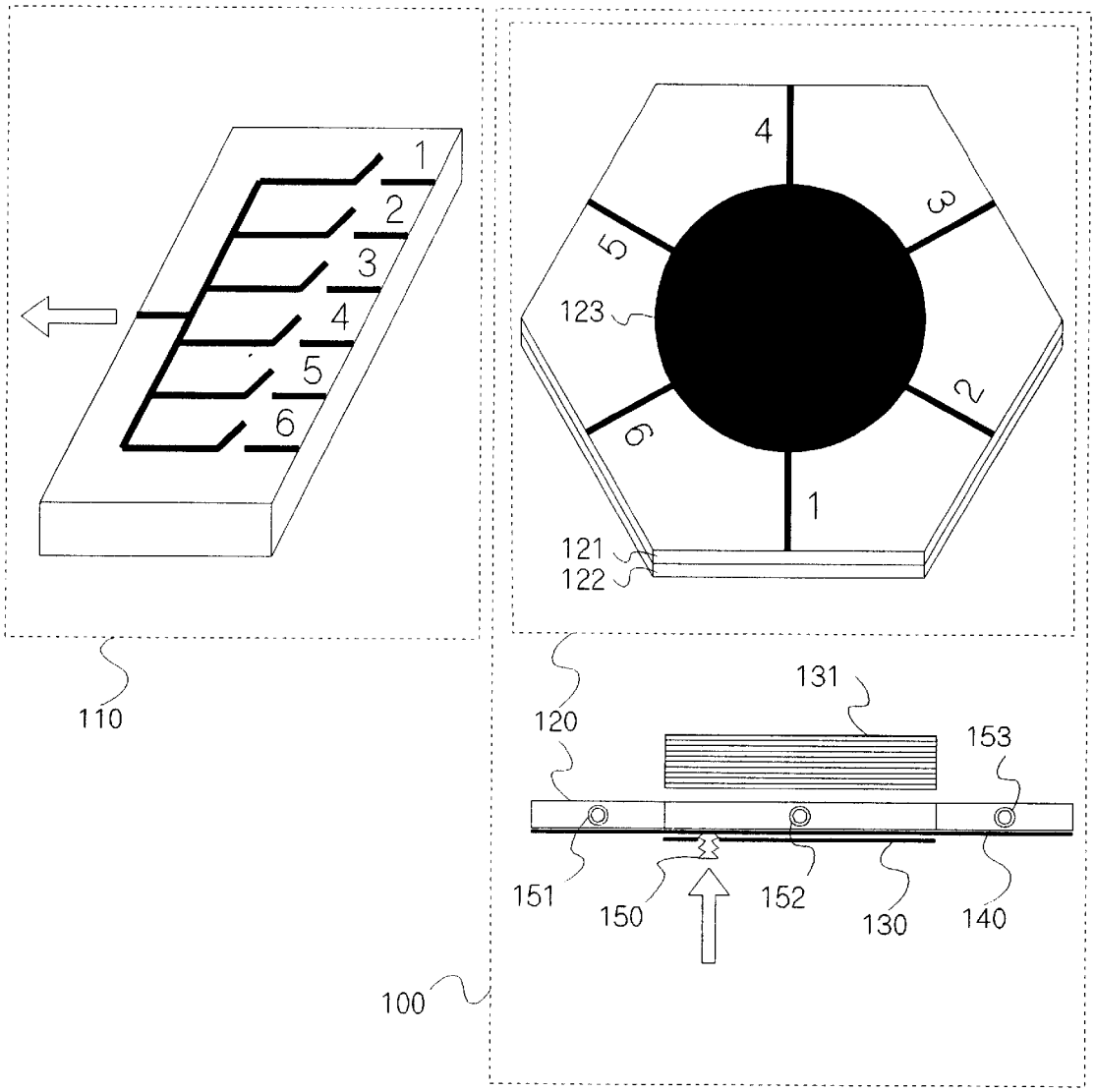
FIG. 1 shows one example of the preferred embodiment of the invention that a phase shifter is fabricated with a microstrip ferrite-disk resonator magnetically biased along the axial direction of the disk.

| | |
|---|---|
| 100, 200, 300 | Microstrip Ferrite Resonator |
| 110, 210 | 1-Pole 6-Throw Switch |
| 410 | Top Cover/Magnet Support |
| 411, 412, 413 | Magnetic-Shield Plate |
| 120, 220, 320 | Substrate and Conductor Circuit |
| 121, 221, 321 | Ferrite Substrate |
| 420 | Ferrite Superstrate |
| 122, 222, 322 | Frequency-Agile Substrate |
| 123, 223, 323, 421, 422, 423, 424 | Conductor Circuit |
| 425 | Dielectric Substrate |
| 130, 230, 330, 430 | Magnetic Image Plane |
| 131, 231, 331, 431, 432, 433, 434 | Permanent Magnet |
| 140, 240, 340, 441, 442 | Ground Plane |
| 150, 250, 350, 450 | Coax Launcher (Input) |
| 151, 152, 153, 251, 252, 253, 352 | Coax Launcher (Output) |
| 354, 451, 452 | Coax Cable |
| 355 | Rotating Arm |
| 460 | Gear Box |
| 361, 362 | Gear |
| 370 | Step Motor |
| 380, 481, 482, 483, 484 | Rotary Joint |
| 490 | Power Splitter (1-to-4) |

BACKGROUND

For an isotropic resonator displaying a circular symmetry, for example, an isotropic dielectric microstrip/stripline disk/ring resonator, the excited modes include both the clockwise and the counterclockwise rotating modes, because these two modes are degenerate in frequency, and wave propagation is reciprocal with respect to rotation around the axial direction. As such, phases are ambiguous if one is attempting to couple out the excited modes of the resonator. This is no longer true for an anisotropic resonator in which the rotational symmetry of the resonator is removed. As a consequence, the two eigenmodes associated with clockwise and counterclockwise rotations of electromagnetic waves assume different frequencies, and excitation of one mode will exclude the other. This implies that the resonant mode is unambiguous in phase, allowing for the resonator to be effectively used as a phase shifter, as discussed shortly.

Among many possible solutions in constructing a non-reciprocal circular resonator, explicit examples are given here for ferrite microstrip/stripline disk/ring resonators, since the design and fabrication of this kind of resonators are well known. In a ferrite disk/ring resonator magnetized along the thickness direction the degeneracy between the two counter-rotating modes is removed, and the resonant frequencies corresponding to these two modes occur at different frequencies, denoted as $f_+$ and $f_-$ for the clockwise and the counterclockwise rotating modes, respectively [C. E. Fay and R. L. Comstock, "Operation of the Ferrite Junction Circulator," IEEE Trans. Microwave Theory Tech., MTT-13, 15, 1965]. While circulator operation is designated at a frequency midway between these two frequencies, $f=(f_++f_-)/2$ [H. How, "Magnetic Microwave Devices," in "Encyclopedia of Electrical and Electronics Engineering," edited by J. G. Webster, Volume 12, page 31–45, John Wiley, March, 2000], circularly polarized radiations are obtained from the disk/ring resonator if the applied frequency is located near one of these two frequencies, $f_+$or $f_-$ [D. M. Pozar, "Radiation and Scattering Characteristics of Microstrip Antennas on Normally Biased Ferrite Substrates," IEEE Trans. Antennas Propag., AP-30, 1084, 1992]. This implies that at resonance the resonant mode in a ferrite resonator exhibiting a circular symmetry consists of only one mode whose phase can thus be determined without ambiguity.

This allows the resonant mode to be coupled out form the resonator with an unambiguous phase, since only a single mode near $f_+$or $f_-$ is excited. That is, if the positions installed with the input and the output ports can be selective changed, their relative phases can thus be varied. Most importantly, phase shift derived in this manner implies low loss in wave propagation, since it is possible to operate the resonator away from ferrimagnetic resonance (FMR). For example, circulators with insertion loss less than 0.1 dB can be readily fabricated with ease. This forms the basis of the invention. In the following discussion $f_+$ is assumed as the resonance frequency, for the reason of clarity.

PREFERRED EMBODIMENT:—FIG. 1

FIG. 1 shows an example of the preferred embodiment of the invention that a phase shifter is obtained with a microstrip ferrite-disk resonator magnetically biased along the axial direction of the disk. In FIG. 1 the substrate and the conductor circuit are designated as 120. The substrate consists of two layers, a ferrite substrate 121 and a frequency agile substrate 122, both shaped as a hexagon, allowing for 6 output ports to be made, designated as port 1, 2, 3, 4, 5, and 6 in FIG. 1. The microstrip conductor circuit 123 is deposited on top of the ferrite substrate 121, and the ground plane 140 is placed on bottom of the frequency agile substrate 122. The conductor circuit 123 consists of a central metal disk patch connected with 6 metal strip patches to be used as output ports. Coax launchers 151, 152, and 153, are installed with port 1, 2, and 3, respectively, and other similar launchers are installed with port 4, 5, and 6, which are not shown in FIG. 1 The output ports are understood to be connected with a 1-pole 6-throw switch 110 with their port numbers matched.

The volume occupied by the ferrite substrate 121 and the frequency agile substrate 122 under the central disk patch of the conductor circuit 123 bound by the ground plane 140 defines the resonator, displaying the geometry of a circular puck or a cylinder. The resonator is fed via a coax cable located under the ground plane in a manner as commonly applied in feeding a microstrip patch antenna. The input port is installed with a coax launcher 150. The resonator is biased by a magnet 131 placed on top of the central metal disk patch of the conductor circuit 123 with an equal or a smaller diameter. An magnetic image plane 130 is placed under the resonator so as to effectively condense or attract the magnetic flux generated from the magnet 131. The magnetic image plane 130 can be made of a thin slab or a layer of magnetic soft material, including, iron, nickel, or their alloys, for example, permalloy.

Thus, as previously explained, in the presence of a magnetic bias field the resonance mode inside the resonator excited at a frequency near $f_+$ consists of only the clockwise rotating wave with an unambiguous phase. The relative phases of the 6 output ports in FIG. 1 are thereof fixed, incremented sequentially by an amount of $\pi/3$ from port 1 to port 6. Here, the resonant mode at $f_+$ is assumed to be the fundamental mode, but not the high-order angular modes. Thus, by selectively closing a switch at 110 the output phase from the phase shifter, 100 plus 110, can be controlled, also in increments of $\pi/3$.

In this example of the preferred embodiment of the invention the non-reciprocal resonator is constructed utilizing the gyromagnetic property of the ferrite substrate 121. This determines the operation frequency $f_+$ and the frequency in mode separation $\Delta f=(f_+-f_-)/2$. The purpose of incorporating a second substrate 122 in FIG. 1 is to provide further control over the performance of the resonator. For example, if high dielectric constant is included with substrate 122, the size of the resonator can be reduced considerably. Minaturized phase shifters are needed by a large phased array system, since the available space for each of the array elements is limited in the system.

Ferroelectric material can also be included with the second substrate 122. To operate, a voltage is applied between the central conductor disk of 123 and the ground plane 140 so as to change the dielectric constant of the second substrate 122. This implies that the resonant frequency of the resonator can be varied, resulting in tuning of the operation frequency of the phase shifter. This facilitates largely its application toward broadband usage. Note that frequency tuning can also be achieved magnetically. If a Helmholtz coil is deployed superposing the permanent magnet 131 in cascade, the bias field inside the ferrite resonator can be changed, resulting in the change of the operation frequency of the phase shifter.

The output port is selected by closing a switch at 110. Depending on the purpose of application, the switch can appear in many different forms, including mechanical switches, optical switches, electronic switches, or electromechanical switches. A mechanical switch might be slow, but it is nevertheless cost effective. Electronic switches can be fabricated with semiconductor junctions located in close proximity to the resonator ports to be integrated with the other phased array elements. Electromechanical switches (MEMSs) provide high isolation between ports. Optical switches are fast devices and response time shorter than 1 nsec can be readily achieved.

In short an rf signal enters the phase shifter of FIG. 1 through the input port launcher 150, undergoing non-reciprocal rotation introduced with the gyromagnetic property of the ferrite substrate 121, to be selectively coupled out at 110. The output phase of the phase shifter can thus be varied in increments of $\pi/3$. Since the resonator dimension is fixed for all of the output ports, operation of the phase shifter is uniform, independent of the angle in phase shifting. This is in contrast to the performance of a conventional phase shifter contained in the art. In order to obtain a large angle in phase shift, the length of the transmission line included with a conventional phase shifter needs to be increased, resulting in a large insertion loss; or, the permittivity/permeability values of the substrate material needs to be varied appreciably, giving rise to a large return loss. In both ways of operation the performance of a conventional phase shifter is non-uniform, requiring individual tuning for each of the fabricated devices.

The demonstration of this example includes 6 output ports. More output ports can be added without a limit. For example, by coupling out the resonator with N output lines feeding into a 1-pole N-throw switch, the output phase can be controlled in increments of $2\pi/N$. It is understood that the hexagon geometry assumed by the ferrite substrate 121 and the frequency agile substrate 122 is not necessary. The role of input and output shown in FIG. 1 can be interchanged, and the input signal can appear at the pole port of 110; after closing an appropriate switch at 110, the signal enters the resonator to be coupled out at the coax launcher 150. Most discussions given to this example can be equally applied to the other examples in association with FIG. 2, FIG. 3, and FIG. 4 to be discussed shortly.

PREFERRED EMBODIMENT:—FIG.2

Figure 2:
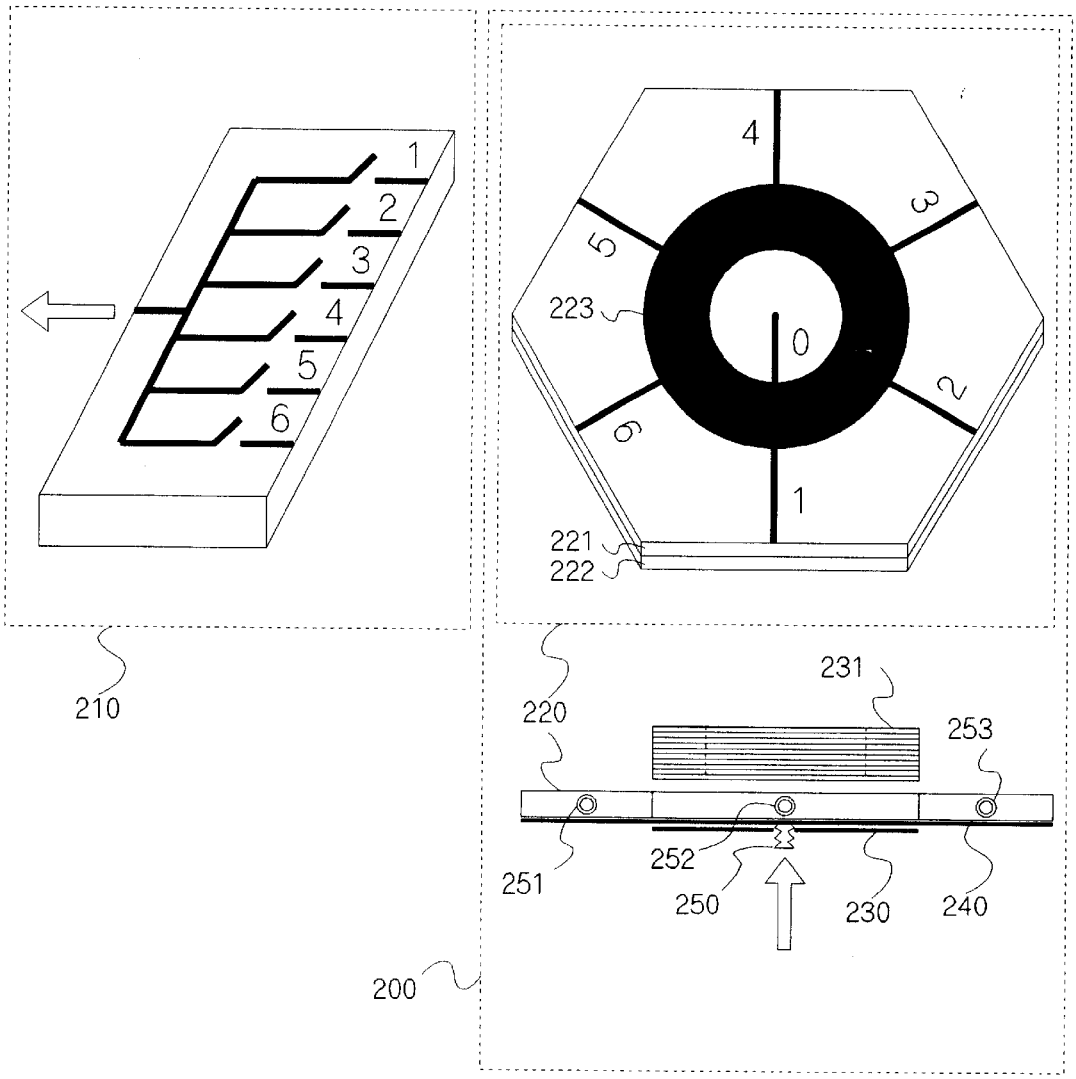
FIG. 2 shows another example of the preferred embodiment of the invention that a phase shifter is fabricated with a microstrip ferrite-ring resonator magnetically biased along the axial direction of the ring.

FIG. 2 shows another example of the preferred embodiment of the invention that a phase shifter is obtained with a microstrip ferrite-ring resonator magnetically biased along the axial direction of the ring. In FIG. 2 the substrate and the conductor circuit are designated as 220. The substrate consists of two layers, a ferrite substrate 221 and a frequency agile substrate 222, both shaped as a hexagon, allowing for 6 output ports to be made, designated as port 1, 2, 3, 4, 5, and 6 in FIG. 2. The microstrip conductor circuit 223 is deposited on top of the ferrite substrate 221, and the ground plane 240 is placed on bottom of the frequency agile substrate 222. The conductor circuit 223 consists of a central metal ring patch connected with 6 metal strip patches at the outer circumference to be used as output ports. Coax launchers 251, 252, and 253, are installed with port 1, 2, and 3, respectively, and other similar launchers are installed with port 4, 5, and 6, which are not shown in FIG. 2. The output ports are understood to be connected with a 1-pole 6-throw switch 210 with their port numbers matched.

The volume occupied by the ferrite substrate 221 and the frequency agile substrate 222 under the central ring patch of the conductor circuit 223 bound by the ground plane 240 defines the ring resonator, displaying the geometry of a hollow cylinder, or a pipe. To be different from the example of FIG. 1, in FIG. 2 the ring resonator is fed by a microstrip line connected to the inner circumference of the ring patch of the conductor circuit 223, designated as port 0. Port 0 joins a coax cable at the center of the substrate hexagon in a conventional manner and the coax cable is installed with a launcher 250 under the ground plane 240. The resonator is biased by a ring-shaped magnet 231 placed on top of the central metal ring patch of the conductor circuit 223 with an equal or a smaller outer diameter and an equal or a larger inner diameter. An magnetic image plane 230 is placed under the resonator so as to effectively condense or attract the magnetic flux generated from the magnet 231. The magnetic image plane 230 can be made of a thin slab or a layer of magnetic soft material, including, iron, nickel, or their alloys, for example, permalloy.

The operation of the phase shifter shown in FIG. 2 is analogous to that shown in FIG. 1 except that the feeding of the input port has been changed from a coax cable into a microstrip line and the disk geometry of the resonator has been changed into a ring. The significance of a second frequency-agile substrate 222 remains the same as before, and the usage of a 1-pole 6-throw switch 210 has already been justified. In the presence of a bias magnetic field the degeneracy between the two counter rotating modes inside the ring resonator is removed, and when excited near one resonant mode, the other mode is effectively suppressed, resulting in single-mode operation that wave propagation is associated with an unambiguous phase. Thus, by closing one switch at 210 to selectively couple out the resonant mode, the output phase at the pole port of 210 can be changed, varying in increments of $\pi/3$, similar to the operation of the phase shifter shown in FIG. 1.

PREFERRED EMBODIMENT:—FIG. 3

Figure 3:
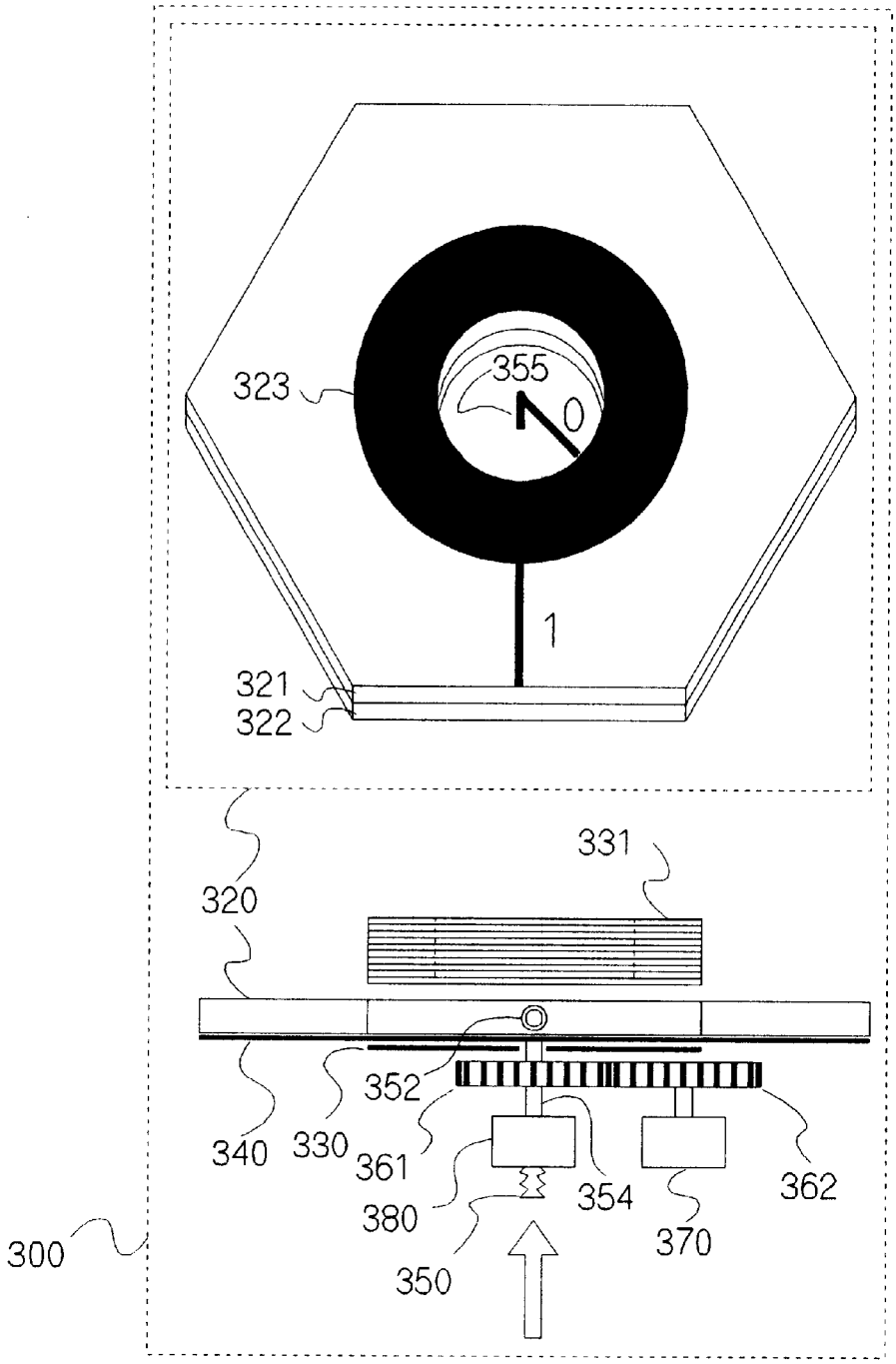
FIG. 3 shows another example of the preferred embodiment of the invention that a phase shifter is fabricated with a microstrip ferrite-ring resonator magnetically biased along the axial direction of the ring. However, instead of using a switch to selectively couple out the resonator mode as shown previously, mechanical switch is used, allowing for continuous change of the phase in the output port.

FIG. 3 shows another example of the preferred embodiment of the invention that a phase shifter is obtained with a microstrip ferrite-ring resonator magnetically biased along the axial direction of the ring, analogous to the example shown in FIG. 2. In FIG. 3 the substrate and the conductor circuit are designated as 320. The substrate consists of two layers, a ferrite substrate 321 and a frequency agile substrate 322, both shaped as a hexagon with a hole at the center. The microstrip conductor circuit 323 is deposited on top of the ferrite substrate 321, and the ground plane 240 is placed on bottom of the frequency agile substrate 322. The conductor circuit 323 consists of a central metal ring patch connected with a metal strip at the outer circumference to be used as the output port, designated as port 1. Coax launcher 352 is installed with port 1. The holes at the ferrite substrate 321 and at the frequency agile substrate 322 coincide with the hole contained by the ring patch of the conductor circuit 323.

The volume occupied by ferrite substrate 321 and frequency agile substrate 322 under the central ring patch of the conductor circuit 323 bound by the ground plane 340 defines the ring resonator, displaying the geometry of a hollow cylinder, or a pipe. The internal surface of the ring resonator coincides with the holes of the ferrite substrate 321, the frequency-agile substrate 322, and the ring patch of the conductor circuit 323. To be different from the example of FIG. 2, in FIG. 3 the ring resonator is fed by a microstrip line using air as the substrate material, designate as port 0. Further more, port 0 is not fixed in position; it can rotate around an axis at the center of the substrate hole, or the ring resonator, contacting loosely with the inside circumference of the ring patch of the conductor circuit 323. Air is used as the substrate material for port 0 so as to facilitate its rotational motion there.

The other end of port 0 is connected to the central conductor of a coax cable 354 placed directly under the ground plane 340. That is, the central conductor of the coax cable 354 penetrates across the ground plane 340 from below, protruding into the hole region formed by the ferrite substrate 321 ane the frequency agile substrate 322, joining port 0 and making a 90° angle at the junction. This forms a rotating arm, consisting of port 0 and the central conductor of the coax cable 354, shaped as letter "L" with upside down, designated as 355 in FIG. 3. The coax cable 354, and hence the rotating arm 355, can be driven into rotational motion by using a step motor 370 connected through a gear assembly constituted by gear 361 and gear 362. A rotary joint 380 is used to isolate the rotational motion of the coax cable 354 from the coax launcher 350, which serves as the entrance for the input signal.

As before, the resonator is biased by a ring-shaped magnet 331 placed on top of the central ring patch of the conductor circuit 323 with an equal or a smaller outer diameter and an equal or a larger inner diameter. An magnetic image plane 330 is placed under the resonator so as to effectively condense or attract the magnetic flux generated from the magnet 331. The magnetic image plane 330 can be made of a thin slab or a layer of magnetic soft material, including, iron, nickel, or their alloys, for example, permalloy.

The operation of the phase shifter shown in FIG. 3 is analogous to that shown in FIG. 2 except that the feeding of the input port has been changed from a stationary port into a rotating port, and the output port has been fixed in position subject to no selection at all without invoking the use of set of switches. The significance of a second frequency agile substrate 322 remains the same as before. In the presence of a bias magnetic field the degeneracy between the two counter rotating modes inside the ring resonator is removed, and when excited near one resonant mode, the other mode is effectively suppressed, resulting in single-mode operation with unambiguous phase for wave propagation.

Thus, the input signal feeds into the rotating coax cable 354, guided by port 0 and coupled into the ring resonator. Depending on the relative position of port 0 and port 1 phase shift can be therefore unambiguously determined. In contrast to examples shown in FIG. 1 and FIG. 2, a phase shifter constructed with a rotating arm eliminates the need for switches, and phase shift occurs at continuous angles. The roles for input and output shown in FIG. 3 can be interchanged, and the resultant performance of the phase shifter is essentially the same. In FIG. 3 more output ports can be added, connected to the outer circumference of the ring patch of the conductor circuit 323 in a manner shown in FIG. 2. For example, if 6 outputs are needed with their relative phases fixed differing by an amount of $\pi/3$ in sequence, one can incorporate a such a conductor circuit 223. This saves 5 phase shifters, if constructed separately each consisting of only one output port, as shown in FIG. 3. Phase shifter with multiple output ports with a fixed phase relationship are required by a 2D steering phased array.

Although a phase shift using mechanical switches, or a rotating arm, is slow, it is nevertheless simple to construct, and hence cost effective. Most importantly, unlike a rotating radar displayed at the air port, phase shifters using mechanical switches still show a conformal shape, and hence they can be carried by a moving vehicle, for example. Phase shifters with rotating arms can be used for most civilian applications, for example, a collision avoidance radar, a GPS navigation/communication radar, and a TV broadcasting radar to be installed with a flight carrier.

PREFERRED EMBODIMENT:—FIG. 4

Figure 4:
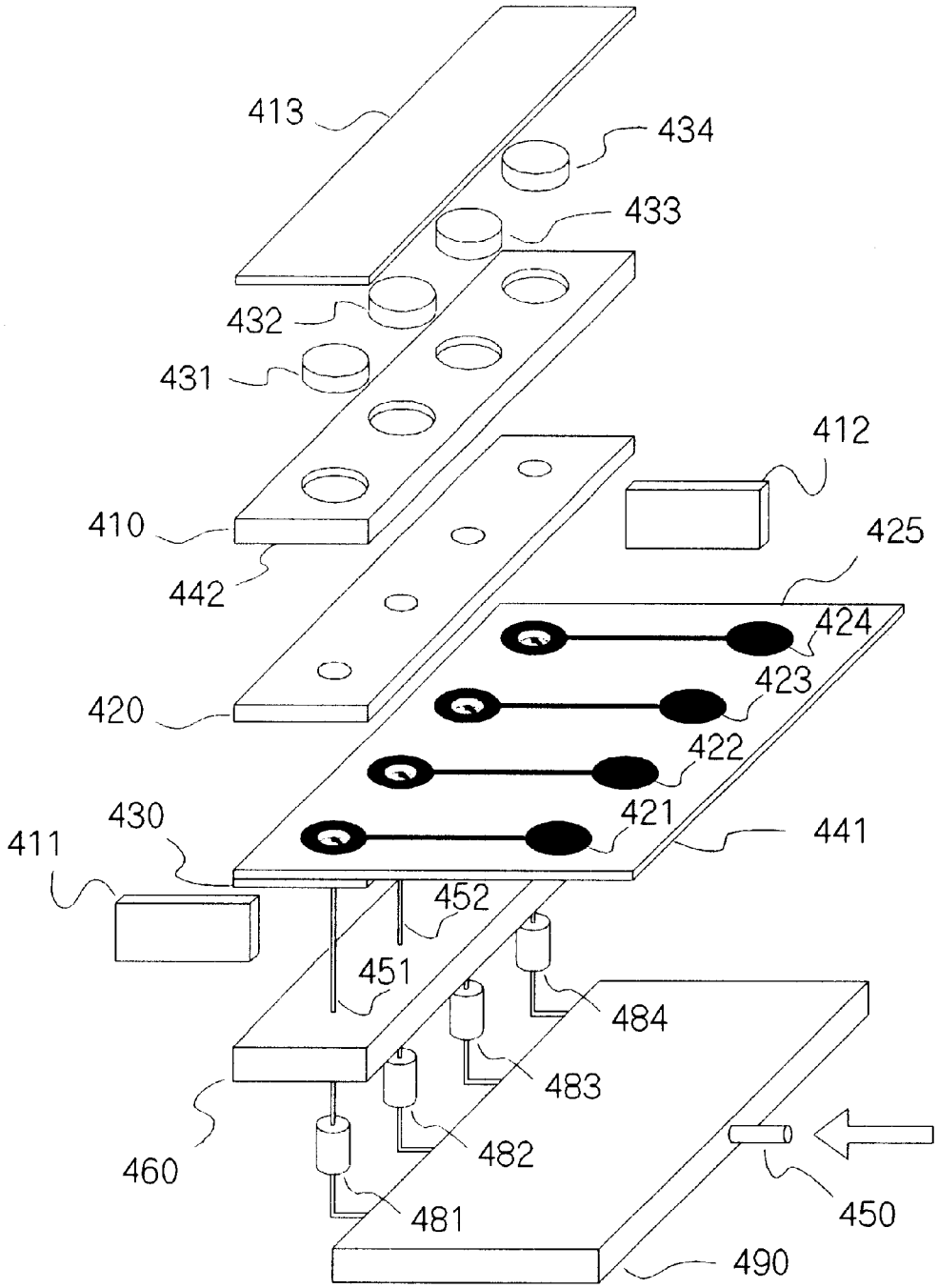
FIG. 4 shows an example that similar apparatus shown in FIG. 3 are combined, feeding into circular microstrip patch antennas, capable of performing the task of beam steering in one dimension. This example suggests an immediate usage of the disclosed device as an anti-collision radar.

FIG. 4 shows another example of the preferred embodiment of the invention that phase shifters are combined, feeding into a phased array performing the task of ID beam steering. Phase shifters considered in this example are essentially the same as those considered with FIG. 3, except that the microstrip geometry of the resonators shown in FIG. 3 has been replaced by a stripline geometry of FIG. 4.

In FIG. 4 the input signal enters the coax launcher 450, followed by a 1-to-4 power splitter 490 so that equal power is partitioned and delivered into 4 coax cables connected to rotary joints 481, 482, 483, and 484. A gear box 460 is used to keep the rotational angles of the coax cables following rotary joints 481, 482, 483, and 484 at a fixed ratio. In order to perform 1D steering the rotational angles, and hence the rotational speeds, are fixed in the ratio of 0:1:2:3, which can be obtained via the use of a gear box 460. Two rotating coax cables are designated as 451 and 452, and the other two rotating coax cables, which are not shown in FIG.4, are also understood. Following these rotating cables, rotating arms are constructed, in a manner discussed in association with 355 in FIG. 3. In FIG. 4 the gear box is driven by a common step motor, which is not shown in the figure.

Non-reciprocal resonators are constructed with a stripline geometry, involving a ferrite superstrate 420 and a dielectric substrate 425. The size of the substrate is bigger than the superstrate and hence stripline circuits extending beyond the coverage from the superstrate becomes microstrip circuits. The ground planes for the stripline circuit 442 and for the stripline and microstrip circuit 441 are shown in FIG. 4. Conductor circuits 421, 422, 423, and 424 contain 3 parts: a metal ring patch for the stripline circuit, a metal disk patch for the microstrip circuit, and a metal strip patch in the middle connecting the ring patch and the disk patch at its two ends. Metal disk patches 421, 422, 423, and 424 deposited on the dielectric substrate 425 with ground plane 441 on the back side form 4 microstrip disk antennas whose phases are subject to change due to operation of the phase shifters located at the other end of the conductor circuits 421, 422, 423, and 424.

In FIG. 4 both the ferrite superstrate 420 and the dielectric substrate 425 have holes coincide with holes included with the ring patches of the conductor circuits 421, 422, 423, and 424. This makes room for the rotating arms, allowing them to rotate freely inside the substrate and superstrate holes, as discussed previously in association with FIG. 3. These rotating arms rotate around axes at the centers of the substrate/superstrate holes, contacting loosely with the inside circumference of the ring patches of the conductor circuits 421, 422, 423, and 424, feeding into microstrip patch antennas to generate a radiation beam.

Magnets 431, 432, 433, and 434, whose diameters are roughly the same as the outer diameter of the ring patches of the conductor circuits 421, 422, 423, and 424, are placed in the magnetic housing holes made with the top cover 410. An magnetic image plane is located under the substrate 425 and the ground plane 441 so as to condense and attract magnetic flux generated from the magnets 431, 432, 433, and 434. Magnetic shielding plate 413 is place on top of the top cover 410 to conceal the magnets 431, 432, 433, and 434 in their housing positions, and magnetic shielding plate 411 and 412 are placed at sides connecting the top magnetic shielding plate 413 with the magnetic image plane 430. This allows magnetic flux to form closed contour so as not to interfere the performance of other surrounding electronic components.

The magnets 431, 432, 433, and 434, the holes in ferrite superstrate 420 and in dielectric substrate 425, and the ring patches of the conductor circuits 421, 422, 423, and 424 are all aligned, and nonreciprocal resonators are form in the ferrite region strictly above the ring patches of the conductor circuits 421, 422, 423, and 424. Thus, wave propagation is non-reciprocal in these resonators and the phase relationship between the input and the output ports is unambiguous. As such, the relative radiation phases of the microstrip patch antennas shown in FIG. 4 depends on the relative positions of the rotating arms feeding into the respective resonators thereby producing phase shifts. By maintaining the rotational angles swept by the rotating arms in proportion, the radiation beam from the antennas can then be made to steer. FIG. 4 constitutes an ideal example that 1D steering radar can be fabricated in a cost effective manner, if the requirement in the speed of steering is not critical. There are many such occasions, as observed for the applications of collision avoidance radars and most of the civilian communication and navigation radars. In FIG. 4 more array elements can be included with the construction, and a frequency-agile layer can be included as well, as required by the broadband applications, for example.

CONCLUSIONS

The present invention discloses a method that allows phase shifters to be fabricated with nonreciprocal resonators so that the phase relationship between the input and the output ports is unambiguous, to be determined from their relative spatial positions. Operation of a phase shifter obtained in this manner is uniform, to be independent of the angle in phase shifting, because there is no need to adjust the electronic properties of the phase shifter, including its permittivity and permeability values. Thus, the disclosed method allows for cost-effective phase shifters with reduced size, showing low insertion loss and low reflection loss.

The present invention discloses two apparatus that allow switches of various kinds to used in performing the task of phase shift, showing the versatility of the invention for a broad range of applications. Simple robust phase shifters can be fabricated using mechanical switches; semiconductor integrated phase shifters can be obtained by using electronic switches; high isolation phase shifters can be achieved by using electromechanical switches (MEMSs); ultra-fast phase shifters can be realized by using optical switches, etc.. Furthermore, miniaturized phase shifters disclosed with this invention can find immediate usage for large phased array systems, and the frequency tuning capability of the phase shifters will favor the broadband applications.

The scope of the invention should be determined by the appended claims and their legal equivalent, rather than by the examples given. It is also understood that the following claims are to cover all generic and specific features of the invention described herein, and all statements of the scope of the invention which, as a matter of language, might be said to fall therebetween.

I claim:

1. A method of obtaining phase shift or phase shifts, comprising:

(A) incorporating a nonreciprocal resonator for which wave propagation is non-degenerate so as to provide single-mode operation, (B) installing one input port or a plurality of input ports, (C) installing one output port or a plurality of output ports, (D) installing a mean or means enabling selection among said input and output ports, or change in their relative positions among said input and output ports, wherein via said mean or means predetermined input and output ports are activated at predetermined positions connected to or coupled with said nonreciprocal resonator with desired relative phases, thereby obtaining said phase shift or phase shifts.

2. The method of claim 1 wherein said nonreciprocal resonator included gyromagnetic materials such as ferrites.

3. The method of claim 1 wherein said nonreciprocal resonator includes frequency agile materials such as ferroelectric materials, materials with high dielectric constants, etc.

4. The method of claim 1 wherein said mean or means involves use of switches.

5. The method of claim 1 wherein said mean or means involves mechanical movement.

6. A phase shifter device capable of performing phase shift function in a non-reciprocal resonator supporting single-mode operation, comprising (A) one or a plurality of fixed ports at predetermined positions, which are connected to said nonreciprocal resonator, or couple tightly to said nonreciprocal resonator at the operation frequency, designated as Group-I ports, (B) a plurality of ports under selection at predetermined positions, which are connected to said nonreciprocal resonator, or couple tightly to said nonreciprocal resonator at the operation frequency, designated as Group II ports, wherein by selecting over said Group II ports the phase of the port being selected relative to the phases of said Group I ports is changed, thereby accomplishing said phase shift function.

7. The phase shifter device of claim 6 wherein said non-reciprocal resonator includes gyromagnetic materials such as ferrites.

8. The phase shifter device of claim 6 wherein said nonreciprocal resonator includes frequency agile materials such as ferroelectric materials, materials with high dielectric constants, etc.

9. The phase shifter device of claim 6 wherein switches are used to select over said Group II ports.

10. The phase shifter device of claim 6 wherein one of said Group I ports serves as the input port and said port being selected among said Group II ports serves as the output port.

11. The phase shifter device of claim 6 wherein said Group I ports serve as output ports and said port being selected among said Group II ports serves as the input port.

12. A phase shifter device capable of performing phase shift function in a non-reciprocal resonator supporting single-mode operation, comprising (A) one or a plurality of fixed ports at predetermined positions, which are connected to said nonreciprocal resonator, or couple tightly to said nonreciprocal resonator at the operation frequency, designated as Group-I ports, (B) a movable port whose position can be changed relative to said Group I ports, coupling tightly to said non-reciprocal resonator at said operation frequency, wherein by changing the position of said movable port the relative phases between said Group I ports and said movable port are changed, thereby accomplishing said phase shift function.

13. The phase shifter device of claim 12 wherein said non-reciprocal resonator includes gyromagnetic materials such as ferrites.

14. The phase shifter device of claim 12 wherein said nonreciprocal resonator includes frequency agile materials such as ferroelectric materials, materials with high dielectric constants, etc.

15. The phase shifter device of claim 12 wherein said position of said movable port is changed via mechanical means.

16. The phase shifter device of claim 12 wherein one of said Group I ports serves as the input port and said movable port serves as the output port.

17. The phase shifter device of claim 12 wherein said Group I ports serve as output ports and said movable port serves as the input port.

* * * * *